US007302385B2

(12) United States Patent
Sung et al.

(10) Patent No.: US 7,302,385 B2
(45) Date of Patent: Nov. 27, 2007

(54) SPEECH RESTORATION SYSTEM AND METHOD FOR CONCEALING PACKET LOSSES

(75) Inventors: Ho Sang Sung, Daejeon (KR); Dae Hwan Hwang, Daejeon (KR); Moon Keun Lee, Seoul (KR); Ki Seung Lee, Seoul (KR); Young Cheol Park, Wonju (KR); Dae Hee Youn, Seoul (KR)

(73) Assignee: Electronics and Telecommunications Research Institute (KR)

( * ) Notice: Subject to any disclaimer, the term of this patent is extended or adjusted under 35 U.S.C. 154(b) by 903 days.

(21) Appl. No.: 10/615,268

(22) Filed: Jul. 7, 2003

(65) Prior Publication Data

US 2005/0010401 A1 Jan. 13, 2005

(51) Int. Cl.
*G10L 19/00* (2006.01)

(52) U.S. Cl. ..... 704/219; 704/214; 704/228

(58) Field of Classification Search ..... 704/214, 704/219, 228

See application file for complete search history.

(56) References Cited

U.S. PATENT DOCUMENTS

| | | | | |
|---|---|---|---|---|
| 6,691,082 | B1 * | 2/2004 | Aguilar et al. | 704/219 |
| 6,754,203 | B2 * | 6/2004 | Wah et al. | 370/352 |
| 2003/0078769 | A1 * | 4/2003 | Chen | 704/211 |

OTHER PUBLICATIONS

"A Concealment Algorithm for Missing Speech Packets i n Packet Voice Communications", Moon-Keun Lee, et al., Dep. of Electrical & Electronic Eng., Yonsie Univ., 4 pages.

* cited by examiner

*Primary Examiner*—David Hudspeth
*Assistant Examiner*—Jakieda R. Jackson
(74) *Attorney, Agent, or Firm*—Blakely, Sokoloff, Taylor & Zafman

(57) ABSTRACT

Provided are a speech restoration system and method for concealing packet losses. The system includes a demultiplexer that demultiplexes an input bit stream and divides the input bit stream into several packets; a packet loss concealing unit that produces and outputs a linear spectrum pair (LSP) coefficient representing the vocal tract of voice and an excitation signal corresponding to a lost frame, when a packet loss occurs; and a speech restoring unit that synthesizes voice using the packets input from the demultiplexer, outputs the result as restored voice, and synthesizes voice corresponding to a lost packet using the LSP coefficient and the excitation signal input from the packet loss concealing unit and outputs the result as restored voice when the lost packet is detected, wherein the packet loss concealing unit repeats linear prediction coefficients (LPCs) of a last-received valid frame, produces a first excitation signal for the lost frame using a time scale modification (TSM) method, when the lost frame is voiceless, and produces a second excitation signal by re-estimating a gain parameter based on the first excitation signal, when the lost frame is voiced.

15 Claims, 4 Drawing Sheets

SPEECH RESTORATION SYSTEM AND METHOD FOR CONCEALING PACKET LOSSES

BACKGROUND OF THE INVENTION

1. Field of the Invention

The present invention relates to a speech restoration system and method for concealing packet losses, and more particularly, to a speech restoration system and method for concealing packet losses when decoding a signal coded by a conventional speech coder.

2. Description of the Related Art

Conventional speech receiving apparatuses use the relationship between a received packet and an adjacent voice signal to conceal packet losses. In general, when packet losses occur, standard speech coders use an extrapolation method-based algorithm that extrapolates coding parameters related to a last-received valid frame before a lost frame, or use a repetition method-based algorithm that repeatedly uses a last-received valid frame before a lost frame. However, a lost packet not only lowers the quality of voice in a section including the lost packet but also causes a loss in data of a long-period prediction memory. As a result, an error in the lost packet may propagate to a next frame. Therefore, even if a speech receiving apparatus receives available packets after the packet losses, the apparatus will use damaged data stored in the long-period prediction memory during a decoding process, resulting in degradation of the voice quality. Accordingly, conventional algorithm adopted by conventional speech decoders is limited by a reduction in the quality of voice and the propagation of an error to a next frame.

The ITU-T G.729 speech coder and G.723.1 are both commonly used in a Voice over Internet Protocol (VoIP) application. The ITU-T G.729 compresses or decompresses input voice at a rate of 8 kbit/s and provides toll quality speech. More specifically, G.729 quantizes spectrum information and excitation signal information using a Code Excited Linear Prediction (CELP) algorithm which is based on a LP speech production model. A packet loss concealing algorithm used in G.729 estimates speech coding parameters in a lost frame using an excitation signal of the last-received valid frame and spectrum information regarding the last-received valid frame when detecting lost packets. During the prediction, the energy of the excitation signal corresponding to the lost frame is gradually decreased to minimize the effects of the packet loss.

If an $n^{th}$ frame is determined to be a lost frame, a spectrum parameter of an $n-1^{th}$ frame, which is the last-received valid frame before the lost frame, is used to replace that of the lost frame. In other words, G.729 estimates a linear prediction coefficient of the lost frame by repeating the linear prediction coefficient of previous valid frame, and then, an adaptive codebook gain and a fixed codebook gain are replaced with a gain of a last-received valid frame that is reduced by a predetermined factor. Also, to prevent the excessive periodicity of concealed voice, the adaptive codebook is delayed by increasing a delay in the previous frame by 1. However, a reduction in the rate of parameters or repetitive use of the parameters unstabilizes the feedback of the energy of decoded voice, and further remarkably lowers the quality of voice when frame losses continuously occur.

SUMMARY OF THE INVENTION

The present invention provides a speech restoration system and method which conceal packet losses and they are compatible with international standard speech coding systems.

According to an aspect of the present invention, there is provided a speech restoration system for concealing packet losses, the system comprising a demultiplexer that demultiplexes an input bit stream and divides the input bit stream into several packets; a packet loss concealing unit that produces and outputs a linear spectrum pair (LSP) coefficient representing the vocal tract of voice and an excitation signal corresponding to a lost frame, when a packet loss occurs; and a speech restoring unit that synthesizes voice using the packets input from the demultiplexer, outputs the result as restored voice, and synthesizes voice corresponding to a lost packet using the LSP coefficient and the excitation signal input from the packet loss concealing unit and outputs the result as restored voice when the lost packet is detected. Here, the packet loss concealing unit repeats linear prediction coefficients (LPCs) of a last-received valid frame, produces a first excitation signal for the lost frame using a time scale modification (TSM) method, and outputs the first excitation signal to the speech restoring unit, when the lost frame is voiceless, and produces a second excitation signal by re-estimating a gain parameter based on the first excitation signal and outputs the second excitation signal to the speech restoring unit, when the lost frame is voiced.

According to another aspect of the present invention, there is provided a speech restoration method of concealing packet losses, the method comprising demultiplexing an input bit stream and dividing the bit stream into several packets; checking whether a loss in the packets occurs; producing a LSP coefficient that represents the vocal tract of voice when packet loss occurs; producing a first excitation signal by performing TSM on an excitation signal produced with respect to a lost frame by repeating LPCs of a last-received valid frame when the lost frame of the packet is voiceless, and producing a second excitation signal by estimating a gain parameter based on the first excitation signal when the lost frame of the packet is voiced; and synthesizing voice corresponding to the lost frame using the LSP coefficient and the first or second excitation signal and outputs restored voice when packet loss occurs.

BRIEF DESCRIPTION OF THE DRAWINGS

The above and other aspects and advantages of the present invention will become more apparent by describing in detail preferred embodiments thereof with reference to the attached drawings in which.

DETAILED DESCRIPTION OF THE INVENTION

A speech restoration system and method according to the present invention are compatible with a conventional existing speech coder and thus can be used in a communication system as well as a speech storage system. Also, they can provide effective voice services suited to the particular type of a channel used by communications network.

A packet loss concealing method according to the present invention is compatible with a conventional low-pass speech coding standard used in a speech storage system or a speech transmission system, and further, can improve the performance of the conventional low-pass speech coding standard. In general, a speech coder divides voice into a transfer function of a vocal tract, which corresponds to a vocal spectrum, and an excitation signal, based on a LP speech production model. In the present invention, if a frame corresponding to a packet lost due to defects in a channel path, is voiceless, the lost packet is concealed using a time scale modification (TSM) method. If the frame is voiced, the packet loss is concealed using a combination of the TSM method and a changed gain parameter re-estimation method. In particular, the present invention focuses on concealing an excitation signal that more greatly affects voice quality than a transfer function of a vocal tract.

Figure 1:
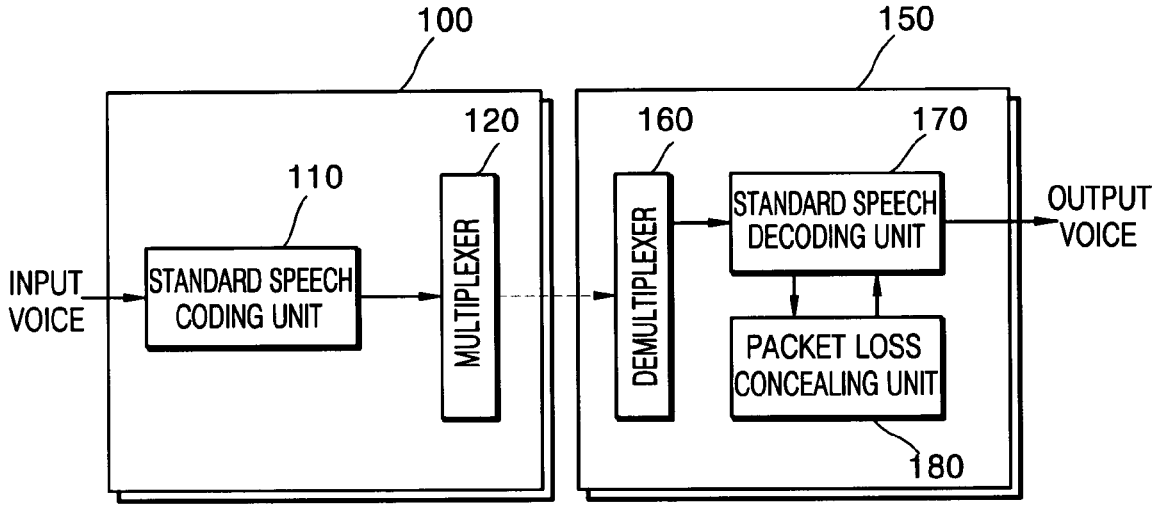
FIG. 1 illustrates a conventional speech coder and a speech restoration system for concealing packet losses according to a preferred embodiment of the present invention, the system being compatible with the conventional speech coder.

FIG. 1 illustrates a transmitter 100 using a standard speech coding unit 110 and a speech restoration system 150 capable of concealing packet losses.

Referring to FIG. 1, the transmitter 100 includes a standard speech coding unit 110 and a multiplexer 120. The standard speech coding unit 110 codes or quantizes input voice according to existing speech coding standards. The standard speech coding unit 110 selects an excitation vector from sets of probabilistic sequences which are stored beforehand. Next, the standard speech coding unit 110 filters every possible code vectors of a codebook so as to obtain a set of output signals that are characterized by different values of a mean square error. Further, the standard speech coding unit 110 selects an excitation value, which makes a minimum mean square error, from the set of output signals.

Using the transmitter 100, it is possible to transmit a code vector, which is selected as the excitation value, to the speech restoration system 150 which is a receiving apparatus. However, it is preferable that an index corresponding to the selected code vector is transmitted to the speech restoration system 150 in order to reduce the amount of transmission. To this end, the speech restoration system 150 includes an identical codebook to the one included in the transmitter 100. The standard speech coding unit 110 extracts a variable of a digital filter and an excitation value to code the input voice.

The multiplexer 120 multiplexes a bit stream input from the standard speech coding unit 110.

The speech restoration system 150 according to the present invention includes a demultiplexer 160, a standard speech decoding unit 170, and a packet loss concealing unit 180.

The demultiplexer 160 demultiplexes the bit stream received from the transmission apparatus 100 and divides the bit stream into several packets. The standard speech decoding unit 170 synthesizes voice based on the demultiplexed packets and outputs the result as restored voice. When the standard speech decoding unit 170 detects a packet loss during the voice synthesis, it synthesizes voice using a line spectrum pair (LSP) coefficient and an excitation signal input from the packet loss concealing unit 180 and outputs the result as restored voice.

When a loss in the demultiplexed packets is detected, the packet loss concealing unit 180 produces the LSP coefficient, which represents the vocal tract of the voice, and the excitation signal which corresponds to the lost frame, and provides them to the standard speech decoding unit 170. Then, the standard speech decoding unit 170 synthesizes voice corresponding to the lost frame, based on the LSP coefficient and the excitation signal received from the packet loss concealing unit 180, and outputs the result as restored voice.

Figure 2:
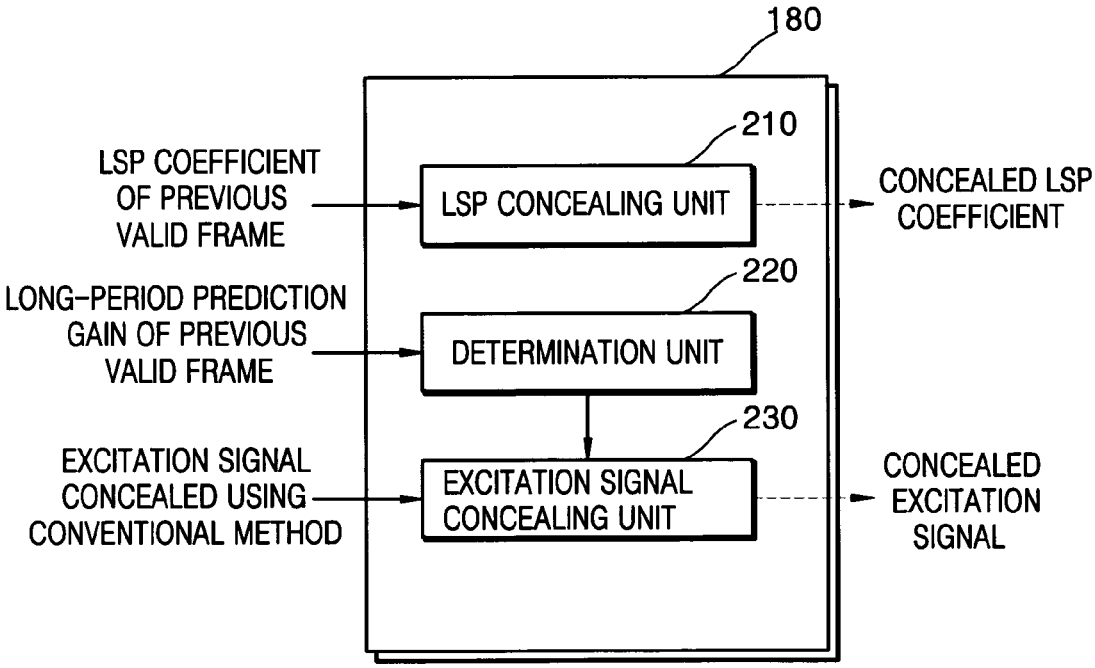
FIG. 2 is a block diagram of a packet loss concealing unit included in a speech restoration system for concealing packet losses, according to a preferred embodiment of the present invention.

FIG. 2 is a block diagram of a packet loss concealing unit 180 included in a speech restoration system 150 for concealing packet losses, according to a preferred embodiment of the present invention. Referring to FIG. 2, the packet loss concealing unit 180 includes an LSP concealing unit 210, a unit 220 for determining whether voice is voiceless or voiced (hereinafter referred to as "determination unit 220"), and an excitation signal concealing unit 230.

The LSP concealing unit 210 produces and outputs an LSP coefficient that represents the vocal tract of voice related to a lost frame, using the LSP coefficient of a last-received valid frame. The LSP coefficient represents the spectrum information of a frame corresponding to a lost packet. The change between the spectrum information of consecutive frames, i.e., LSP coefficients, is not great. Based on the characteristics of the LSP coefficients, the LSP concealing unit 210 replaces the LSP coefficient of the lost frame using the LSP coefficient of a last-received valid frame, received right before the lost frame.

The determination unit 220 determines whether voice of a code train corresponding to the lost frame is voiceless or voiced, using a long-period prediction gain of the last-received valid frame. The determination unit 220 determines the type of voice indicated by the code train corresponding to the lost frame, using a long-period prediction gain related to the last-received valid frame which consists of voiceless and voiced sounds which are modelled with an impulse train and pseudo noise, respectively.

The excitation signal concealing unit 230 produces excitation signal using different algorithms, depending on whether vocal information input from the determination unit 220 relates to a voiced sound or a voiceless sound.

Figure 3:
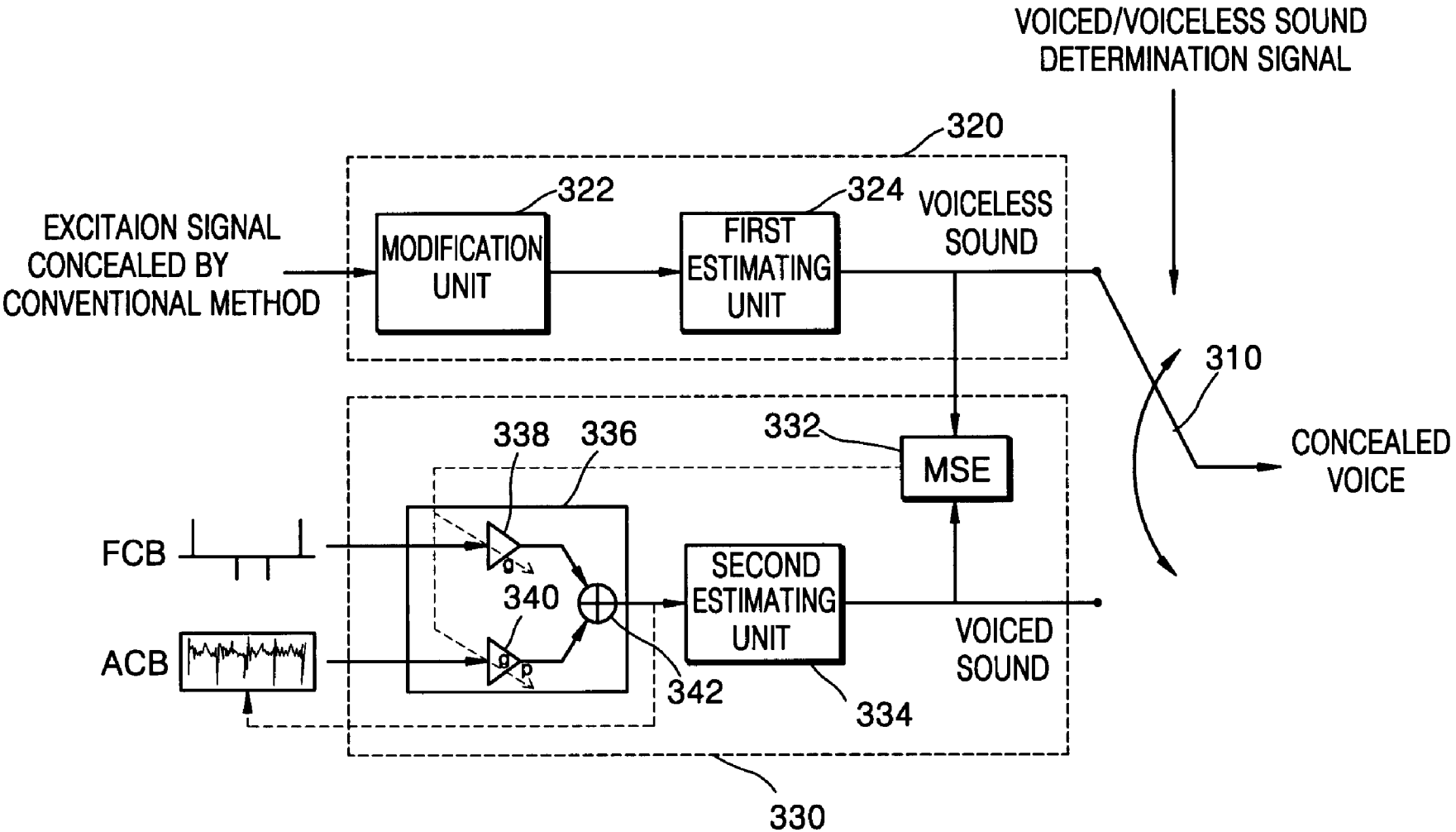
FIG. 3 is a block diagram of an excitation signal concealing unit installed in the packet loss concealing unit of FIG. 2, according to a preferred embodiment of the present invention.

FIG. 3 is a block diagram of an excitation signal concealing unit 230 according to a preferred embodiment of the present invention. Referring to FIG. 3, the excitation signal concealing unit 230 includes a switching unit 310, a time scale modification (TSM) unit 320, and a parameter re-estimator 330.

The switching unit 310 selects one of a signal output from the TSM unit 320 and a signal output from the parameter re-estimator 330, in response to a signal output from the determination unit 220 of FIG. 2. The selected signal is provided to the standard speech decoding unit 170.

The TSM unit 320 conceals an excitation signal using a TSM method in which only a recognition rate of the articulation of each syllable is changed. The TSM unit 320 includes a modification unit 322 and a first estimating unit 324.

The modification unit 322 receives an excitation signal, which is concealed using a conventional method, and produces a new excitation signal using the TSM method such as a Waveform Similarity-based Overlap-Add (WSOLA) method.

Figure 4:
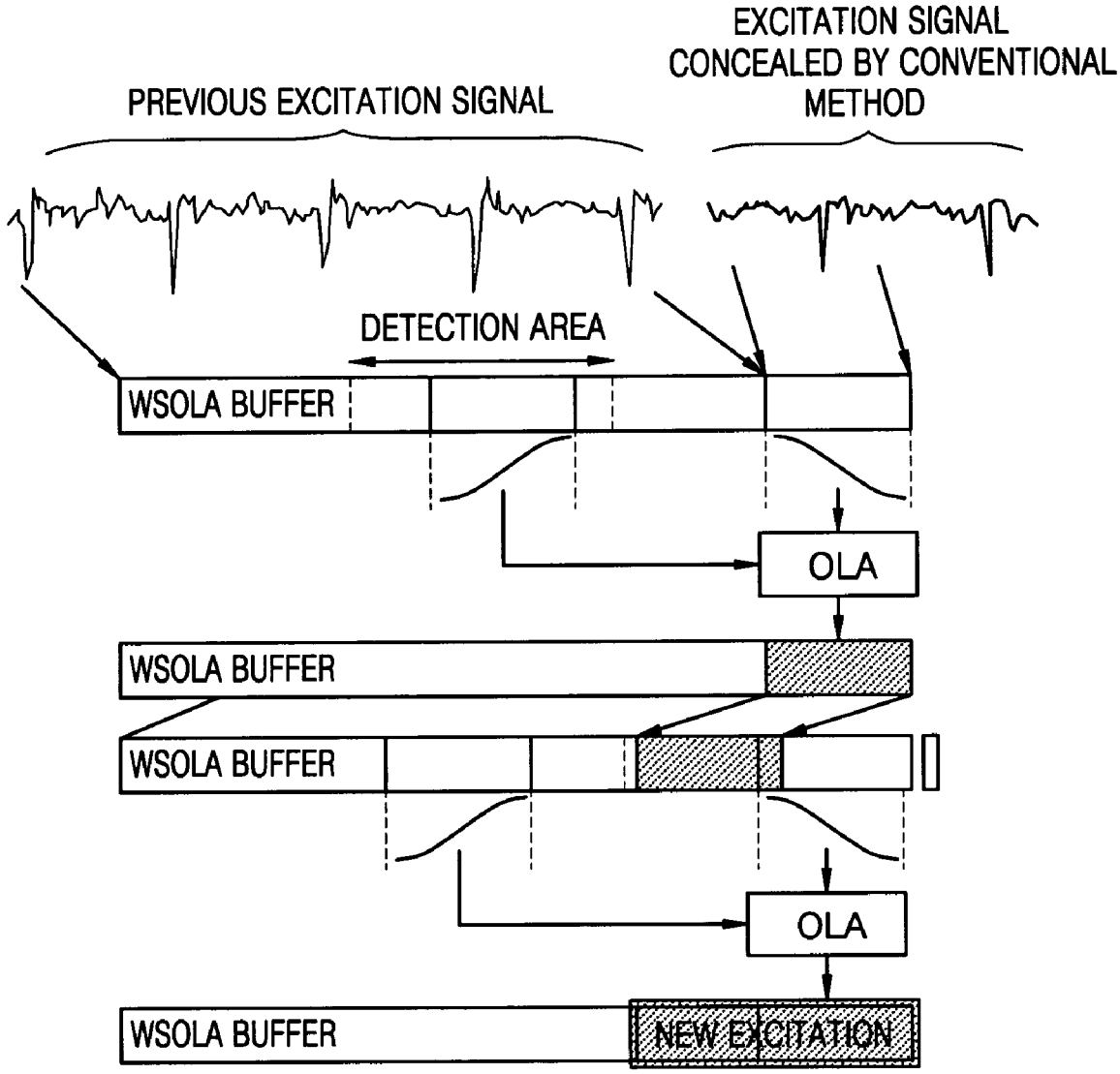
FIG. 4 illustrates a method of producing an excitation signal by applying a Waveform Similarity-based Overlap-Add (WSOLA) method using the excitation signal concealing unit of FIG. 3.

FIG. 4 illustrates a method of producing an excitation signal by applying the WSOLA method in units of sub frames.

Referring to FIGS. 3 and 4, the modification unit 322 receives an excitation signal, which is concealed using a conventional method, and extracts a section having the highest similarity from sections detected by a WOLA buffer. Then, the modification unit 322 produces an excitation signal, which will substitute for a lost frame section, using an Over-Lap Add (OLA) method. When applying a method of concealing an excitation signal to a next sub frame, a dynamic buffer is used to prevent any effects due to the excitation signal that is concealed using the conventional method with a time-warping function used in the WSOLA method.

The first estimating unit 324 synthesizes the excitation signal input from the modification unit 322 using a Linear Prediction Coefficient (LPC) and outputs the result as a final excitation signal.

The parameter re-estimator 330 conceals the excitation signal using a combination of the TSM method and a changed gain parameter re-estimation method. The parameter re-estimator 330 includes an error calculator 332, a second estimating unit 334, and a vector estimating unit 336. The error calculator 332 calculates a mean square error between a target signal t(n) input from the TSM unit 320 and the excitation signal input from the second estimating unit 334 so as to obtain a gain control signal. The gain control signal is used to re-estimate a gain parameter.

The vector estimating unit 336 includes a first estimating unit 338, a second estimating unit 340, and an adder 342. The first estimating unit 338 estimates an adaptive codebook gain, which minimizes a mean square error, using the gain control signal and an adaptive codebook (ACB) vector. The second estimating unit 340 estimates a fixed codebook gain, which minimizes a mean square error, using the gain control signal and a fixed codebook (FCB) vector. The ACB vector is a vector that models a periodical component of voice, and the FCB vector is a vector that models a non-periodical component of voice. The adder 342 adds prediction gains input from the first and second estimating units 338 and the 340 to produce an excitation signal.

The second estimating unit 334 synthesizes the excitation signal input from the adder 342 using an LPD and produces the result as a final excitation signal.

In order to correspond to the selection of the switching unit 310, the excitation signal concealing unit 230 selects and outputs one of the excitation signal output from the TSM unit 320 and the excitation signal output from the parameter re-estimator 330. The standard speech decoding unit 170 receives the LSP coefficient and the excitation signal from the packet loss concealing unit 180, passes the excitation signal through a digital filter, which consists of an input LSP coefficient, and restores the original voice of the lost frame.

Figure 5:
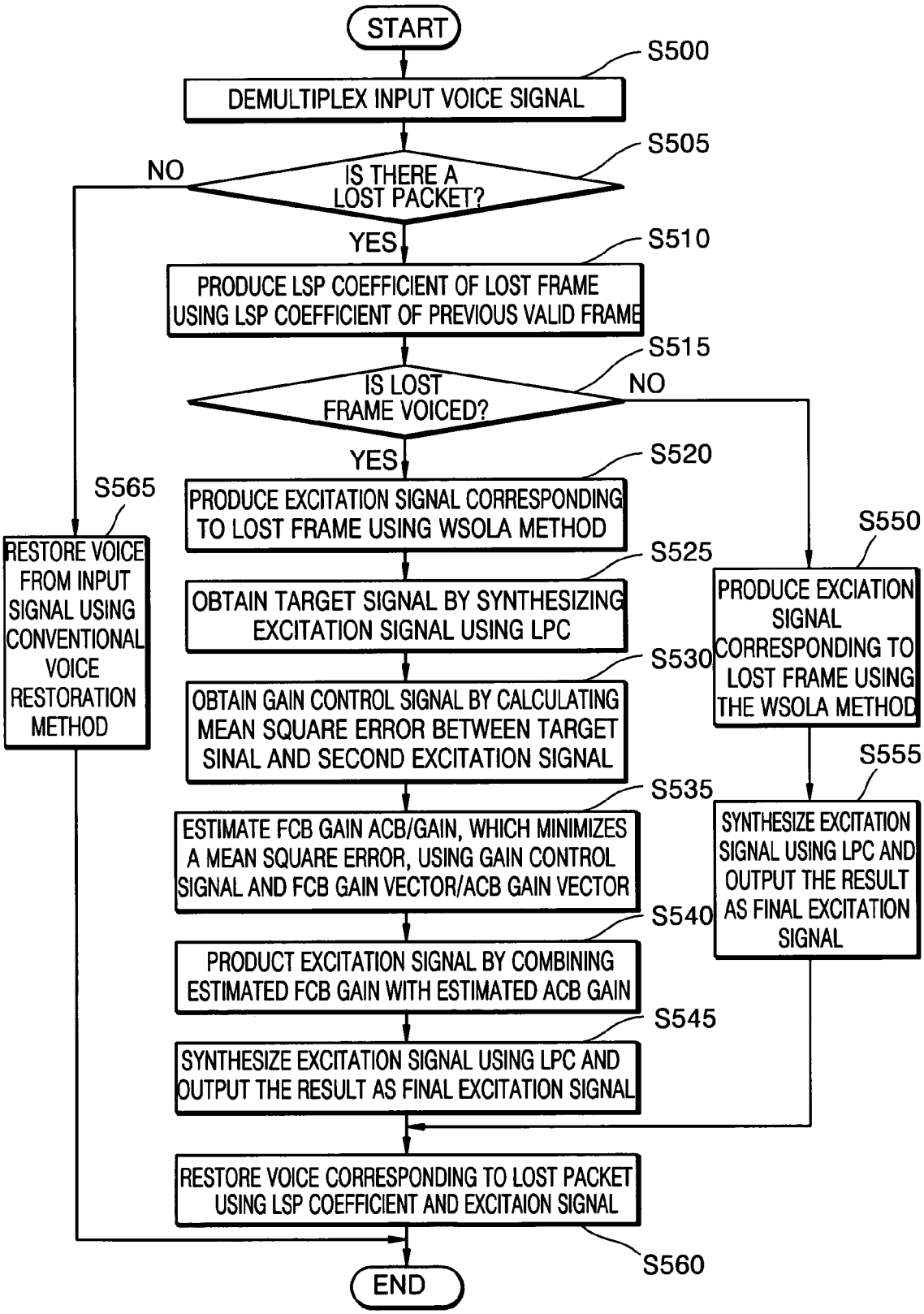
FIG. 5 is a flowchart illustrating a speech processing method which conceals packet losses, according to a preferred embodiment of the present invention.

FIG. 5 is a flowchart illustrating a speech processing method for concealing packet losses, according to a preferred embodiment of the present invention. The method of FIG. 5 will now be described with reference to the accompanying drawings. Referring to FIG. 5, the demultiplexer 160 demultiplexes an input voice signal and outputs the result in step 500. Next, the standard speech decoding unit 170 checks whether a signal input from the demultiplexer 160 has an error in step 505. If the signal does not contain an error, the standard speech decoding unit 170 restores voice from the input signal using a conventional speech restoration method in step 565. However, if the signal contains an error, the standard speech decoding unit 170 restores voice related to a lost packet, using an LSP coefficient and an excitation signal which are produced using a packet loss concealing method according to the present invention.

In step 510, when packet loss is detected, the LSP concealing unit 210 produces an LSP coefficient of a lost frame, based on the LSP coefficient of a last-received valid frame. Then, in step 515 the determination unit 220 determines whether a signal corresponding to the lost frame is voiceless or voiced, based on a long-period prediction gain of the last-received valid frame.

In step 520, if the lost frame is a voiced sound, the modification unit 322 included in the TSM unit 320 produces an excitation signal corresponding to the lost frame using the WSOLA method. In step 525, the first estimating unit 324 of the TSM unit 320 acquires a target signal by synthesizing the excitation signal input from the modification unit 322 using an LPC. In step 530, the error calculator 332 of the parameter re-estimating unit 330 acquires a gain control signal for re-estimation of a gain parameter by calculating a mean square error between the target signal and excitation signal, which is input from the second estimating unit 334. In step 535, the vector estimating unit 336 of the parameter re-estimator 330 estimates a FCB gain/a ACB gain, which minimizes a mean square error, using the gain control signal and a FCB gain vector/an ACB gain vector. In step 530, the adder 342 of the parameter re-estimator 330 combines the estimated FCB gain with the estimated ACB gain so as to produce an excitation signal. In step 545, the second estimating unit 334 synthesizes the excitation signal using the LPC and outputs the result as a final excitation signal.

Meanwhile, in step 550, if the lost frame is a voiceless sound, the modification unit 322 of the TSM unit 320 produces an excitation signal corresponding to the lost frame using the WSOLA method. In step 555, the first estimating unit 324 of the TSM unit 320 synthesizes the excitation signal input from the modification unit 322 using the LPC and outputs the result as a final excitation signal.

Based on a voiced/voiceless sound determination signal, the switching unit 310 selectively outputs one of the excitation signal produced in step 545 and the excitation signal produced in step 555. The standard speech decoding unit 170 restores voice for the lost packet using the LSP coefficient and the excitation signal input from the packet loss concealing unit 180 in step 560.

While this invention has been particularly shown and described with reference to preferred embodiments thereof, it will be understood by those skilled in the art that various changes in form and details may be made therein without departing from the spirit and scope of the invention as defined by the appended claims.

As described above, a speech restoration system and method according to the present invention differently perform a packet loss concealing operation depending on whether a lost packet is voiced or voiceless. Therefore, the system and method are applicable to a general Code Excited Linear Prediction (CELP) type speech coder that is based on a vocalization model and can provide high-quality voice services without largely changing a conventional system. In particular, the system and method are advantageous in that they are compatible with a speech coding method adopted by a voice over Internet protocol (VoIP) communication system, thereby greatly improving the quality of input voice.

What is claimed is:

1. A speech restoration system for concealing packet losses, the system comprising:

a demultiplexer that demultiplexes an input bit stream and divides the input bit stream into several packets;

a packet loss concealing unit that produces and outputs a linear spectrum pair (LSP) coefficient representing the vocal tract of voice and an excitation signal corresponding to a lost frame, when a packet loss occurs; and a speech restoring unit that synthesizes voice using the packets input from the demultiplexer, outputs the result as restored voice, and synthesizes voice corresponding to a lost packet using the LSP coefficient and the excitation signal input from the packet loss concealing unit and outputs the result as restored voice when the lost packet is detected, wherein the packet loss concealing unit repeats linear prediction coefficients (LPCs) of a last-received valid frame, produces a first excitation signal for the lost frame using a time scale modification (TSM) method, and outputs the first excitation signal to the speech restoring unit, when the lost frame is voiceless, and produces a second excitation signal by re-estimating a gain parameter based on the first excitation signal and outputs the second excitation signal to the speech restoring unit, when the lost frame is voiced.

2. The system of claim 1, wherein the packet loss concealing unit comprises:

an LSP concealing unit that produces and outputs a LSP coefficient so as to indicate the vocal tract of voice for the lost frame, based on the LSP coefficient of the last-received valid frame;

a determination unit that determines whether voice is voiced or voiceless from a long-period prediction gain of the last-received valid frame, the voice indicated by a code train corresponding to the lost frame; and an excitation signal concealing unit that performs TSM on an excitation signal produced to replace the lost frame by repeating the LPCs of the last-received valid frame in order to produce the first excitation signal, when the lost frame is voiceless, and produces the second excitation signal by re-estimating a gain parameter based on the first excitation signal, when the lost frame is voiced.

3. The system of claim 2, wherein the determination unit determines whether voice is voiced or voiceless from the long-period prediction gain of the last-received valid frame, the voice indicated by a code train corresponding to the lost frame.

4. The system of claim 2, wherein the excitation signal concealing unit comprises:

a TSM unit that extracts a section having the highest similarity with an excitation signal from a previous excitation signal, and produces the first excitation signal by performing TSM on the extracted section, the excitation signal being produced with respect to the lost frame by repeating the LPCs of the last-received valid frame;

a parameter re-estimator that estimates a codebook gain based on a mean square error between the first excitation signal and a feedback of the second excitation signal and produces the second excitation signal; and a switching unit that selectively outputs one of the first excitation signal input from the TSM unit and the second excitation signal input from the parameter re-estimator, in response to a voiced/voiceless sound determination signal input from the determination unit.

5. The system of claim 4, wherein the TSM unit comprises:

a modification unit that extracts a section having the highest similarity with an excitation signal from a previous excitation signal, sequentially combining the section with the previous excitation signal in units of sub frames, using an overlap-add method, and produces a third excitation signal, the excitation signal being produced with respect to the lost frame by repeating the LPCs of the last-received valid frame; and a first estimating unit that synthesizes the third excitation signal using an LPC and produces the first excitation signal.

6. The system of claim 5, wherein the modification unit comprises a dynamic buffer in which the excitation signal and the previous excitation signal are dynamically stored, the excitation signal being produced with respect to the lost frame by repeating the LPCs of the last-received valid frame.

7. The system of claim 4, wherein the parameter re-estimator comprises:

an error calculator that calculates a mean square error between the first excitation signal input from the TSM unit and the feedback of the second excitation signal and produces a gain control signal for re-estimation of the gain parameter;

a vector estimator that estimates the gain control signal, codebook gains of an adaptive codebook (ACB) vector and a fixed codebook (FCB) vector, combines the estimated ACB gain with the estimated FCB gain, and produces a fourth excitation signal; and a second estimating unit that synthesizes the fourth excitation signal using a LPC and produces the second excitation signal.

8. A speech restoration method of concealing packet losses, the method comprising:

demultiplexing an input bit stream and dividing the bit stream into several packets;

checking whether a loss in the packets occurs;

producing a LSP coefficient that represents the vocal tract of voice when packet loss occurs;

producing a first excitation signal by performing TSM on an excitation signal produced with respect to a lost frame by repeating LPCs of a last-received valid frame when the lost frame of the packet is voiceless, and producing a second excitation signal by estimating a gain parameter based on the first excitation signal when the lost frame of the packet is voiced; and synthesizing voice corresponding to the lost frame using the LSP coefficient and the first or second excitation signal and outputs restored voice when packet loss occurs.

9. The method of claim 8, wherein the production and output of the LSP coefficient are performed using a LSP coefficient of a previously input available frame, the LSP representing the vocal tract with respect to the lost frame.

10. The method of claim 8, wherein during the production of the first or second excitation signal, whether voice is voiced or voiceless is determined from a long-period prediction gain of the last-received valid frame, the voice indicated by a code train corresponding to the lost frame.

11. The method of claim 8, wherein the production of the first or second excitation signal comprises:

producing the first excitation signal by performing TSM on an excitation signal produced with respect to the lost frame by repeating the LPCs of the last-received valid frame, when the lost frame is voiceless; and producing the second excitation signal by estimating the gain parameter based on the first excitation signal when the lost frame is voiced.

12. The method of claim 11, wherein the production of the first excitation signal comprises:

producing a third excitation signal by extracting a section having the highest similarity with an excitation signal from a previous excitation signal, sequentially overlap-adding the section with the previous excitation signals, and producing a third excitation signal, the excitation signal being produced with respect to the lost frame by repeating the LPCs of the last-received valid frame; and producing the first excitation signal by synthesizing the third excitation signal using an LPC.

13. The method of claim 12, wherein during the production of the third excitation signal, the excitation signal, which is produced with respect to the lost frame by repeating the LPCs of the last-received valid frame, and the previous excitation signal are dynamically stored.

14. The method of claim 11, wherein the production of the second excitation signal comprises:

producing the first excitation signal by extracting a section having the highest similarity with an excitation signal from previous excitation signals, and performing TSM on the extracted section, the excitation signal being produced with respect to the lost frame by repeating the LPCs of the last-received valid frames; and producing the second excitation signal by estimating a codebook gain using a mean square error between the first excitation signal and a feedback of the second excitation signal.

15. The method of claim 14, wherein the production of the second excitation signal comprises:

producing a gain control signal for re-estimation of a gain parameter by calculating a mean square error between the first excitation signal and a feedback of the second excitation signal;

producing a fourth excitation signal by estimating the gain control signal and codebook gains of an ACB vector and a FCB vector and combining the estimated ACB gain with the estimated FCB gain; and producing the second excitation signal by synthesizing the fourth excitation signal using an LP.

* * * * *